US006330754B1

(12) United States Patent
McAllister

(10) Patent No.: US 6,330,754 B1
(45) Date of Patent: Dec. 18, 2001

(54) DOOR FOR EAR CORN DRYER

(75) Inventor: Ken McAllister, Horicon, WI (US)

(73) Assignee: KC Manufacturing Inc., Columbus, WI (US)

( * ) Notice: Subject to any disclaimer, the term of this patent is extended or adjusted under 35 U.S.C. 154(b) by 0 days.

(21) Appl. No.: 09/524,902

(22) Filed: Mar. 14, 2000

(51) Int. Cl.[7] ..... F26B 19/00; F27D 1/18
(52) U.S. Cl. ..... 34/202; 34/174; 432/250
(58) Field of Search ..... 34/202, 210, 168, 34/174–175; 110/172, 173 R; 432/250

(56) References Cited

U.S. PATENT DOCUMENTS 4,212,115 * 7/1980 Adler ..... 34/215
5,797,196 * 8/1998 Stanfield ..... 34/175
6,163,978 * 12/2000 Hinner ..... 34/174

* cited by examiner

*Primary Examiner*—Gregory Wilson
(74) *Attorney, Agent, or Firm*—Donald Cayen

(57) ABSTRACT

An access door to a pressurized enclosure such as an ear corn dryer swings about an axis of rotation that divides the door into first and second panels. If the door axis of rotation is midway between the door edges, forces on the panels from the pressurized air when the door is closed are substantially equal. A person need exert only a nominal force on one of the panels to open the door. Preferably, one of the panels has a larger area than the other panel. The force produced on the larger panel keeps the access door closed such that a measurable force must be exerted by a person to open the door. The door is sealed on opposite faces when the door is closed.

26 Claims, 4 Drawing Sheets

DOOR FOR EAR CORN DRYER

BACKGROUND OF THE INVENTION

This invention pertains to agricultural equipment, and more particular to apparatus for drying seed.

DESCRIPTION OF THE PRIOR ART

A vital step in processing some agricultural seed is drying the seed. Especially with corn, it is imperative that the kernels contain no more than a predetermined amount of moisture. Since ear corn as harvested almost always contains more moisture than is acceptable for storage and germination, it is necessary to artificially dry the corn. For that purpose, large ear corn dryers have been developed and are in widespread use.

A popular type of ear corn dryer is the single-pass reversing dryer. A typical single-pass reversing ear corn dryer is a large enclosure that can reach 25 or more feet in height. An enclosure length of approximately 50 feet and a width of approximately 25 feet are typical. A perforated floor extends between the enclosure walls several feet above and at an angle to the enclosure bottom floor. At the lower end of the perforated floor adjacent a back wall is an unloading door. A fill door is in the enclosure roof over the upper end of the perforated floor. The ear corn to be dried is loaded onto the perforated floor through the fill door. There is also an access door to the enclosure. The access door enables a person to walk into the enclosure for inspection and maintenance purposes.

A plenum is built on the outside of one of the enclosure walls. The plenum connects with the enclosure through a top opening in the enclosure wall above the perforated floor. The plenum also connects to the enclosure through a bottom opening below the perforated floor. The bottom opening is selectively closeable by a diverter door.

A blower connected to the plenum utilizes atmospheric air to produce drying air under pressure in the plenum. The diverter door is used to direct the flow of the drying air from the plenum to the enclosure. If the diverter door is in a first position, the drying air flows through the enclosure bottom opening into the enclosure. With the access door closed, the drying air flows upwardly through the perforated floor, through the ear corn loaded on the perforated floor, and out the fill door in the enclosure roof. Typically, the blower produces an air pressure inside the enclosure of between approximately three inches and five inches of water.

In a reverse drying process, the diverter door is in a second position. The atmospheric drying air then enters the enclosure through the top opening between the plenum and the enclosure. The fill door is closed, but the access door is opened. The drying air flows downwardly through the ear corn loaded on the perforated floor and then flows out the access door.

Ear corn dryers as generally described have been in use for many years, and they give generally satisfactory performance. An exemplary ear corn dryer is manufactured by KC Manufacturing, Inc. of Columbus, Wis. However, a potential problem with the prior ear corn dryers concerns the access door. As mentioned, the access door is closed when the atmospheric drying air flows from the plenum into the enclosure through the bottom opening and out the fill door. The pressurized drying air in the enclosure exerts a considerable force on the access door. For example, for a door four feet wide and eight feet high and an air pressure of three inches of water inside the ear corn dryer, the force on the closed access door was approximately 500 pounds.

To prevent the prior access door from flying open when released from the outside by a person who must enter the operating ear corn dryer, the access door was designed to open only inwardly into the dryer. However, the force holding the access door closed was too large for the person to overcome. Therefore, the dryer had to be shut down in order for the person to open the access door and enter the dryer. Once inside the dryer, the person was trapped while the dryer was operating. After completing his inspection or other work inside the operating dryer, it had to again be shut down so the person could open the access door and leave the dryer. The dryer shut downs and restarts to accommodate inspections and other work resulted in unproductive down time.

A related situation occurred in the reverse drying operation when the drying air flowed out the access door. The access door had to be reliably held open. If the access door became free to close unintentionally, it would slam shut with a great speed and force. If a person was in the way, injury could result.

To solve the problems associated with the prior access doors, it is known to build air locks over them. The air locks help to equalize the forces on both sides of the access doors for safer entry into and exit from the enclosures by operating personnel. With an air lock, the access door can be narrower than a normal door. Although generally satisfactory, the air lock design is undesirably expensive.

Thus, a need exists for an improved way to enter and leave an operating ear corn dryer.

SUMMARY OF THE INVENTION

In accordance with the present invention, a door is provided that permits safer entry into and exit from a pressurized enclosure than was previously possible. This is accomplished by designing the door to swing about an axis that is at approximately the midpoint of opposed edges of the door.

According to one aspect of the invention, the door swings about a vertical axis. For that purpose, the door includes two concentric pins, one each in a top edge and a bottom edge of the door. The pins are approximately midway between the door vertical edges. The door is thus divided into first and second panels, one on each side of a vertical axis of rotation through the pins. The pins are rotatable within a door casing in a wall of the pressurized enclosure.

The door swings between open and closed positions. When in the closed position, the door completely closes the casing in the enclosure wall. A first face of the door is then toward the outside of the enclosure, and a second face is toward the inside of the enclosure. When the door is closed, it is sealed against the door casing. When the door is open, the door first panel swings inside the enclosure, and the second panel swings outside the enclosure.

If the pins are midway between the door vertical edges, the forces on the two door panels are equal when the door is closed and the enclosure is pressurized. In that situation, the equal forces create equal and opposite torques about the door axis of rotation. Only a small external force, such as a person pushing lightly on the first panel from outside the enclosure, is needed to open the door. The person can safely enter the enclosure, and close the door behind him without danger of the door slamming shut. When the person wants to leave the enclosure, he merely either pushes lightly on the door second panel or pulls the door first panel. The door again swings easily open.

Because a door with equal area first and second panels has equal forces applied to it by the pressurized air, the door may flutter when closed. To assure that the door remains closed when the enclosure is pressurized, the door first panel is made with a larger area than the second panel. To do so, the door pins are located slightly closer to the vertical edge of the door second panel than to the vertical edge of the first panel. Consequently, the force on the door first panel from the pressurized air is greater than the force on the second panel. The door is thus held closed by a small net torque about the axis of rotation. Accordingly, a small but intentional manual effort is required to open the door.

It is a feature of the invention that the door is not limited to swinging about a vertical axis. The door is equally useful for swinging about a horizontal axis in a roof of a pressurized enclosure.

The method and apparatus of the invention, using a door with equal or approximately equal forces on both sides of an axis of rotation about which the door swings, thus provides easy and safe entry into and exit from a pressurized enclosure. The probability of injury to a person opening, walking through, and closing the door is remote, even though large forces act on both panels of the door.

Other advantages, benefits, and features of the present invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
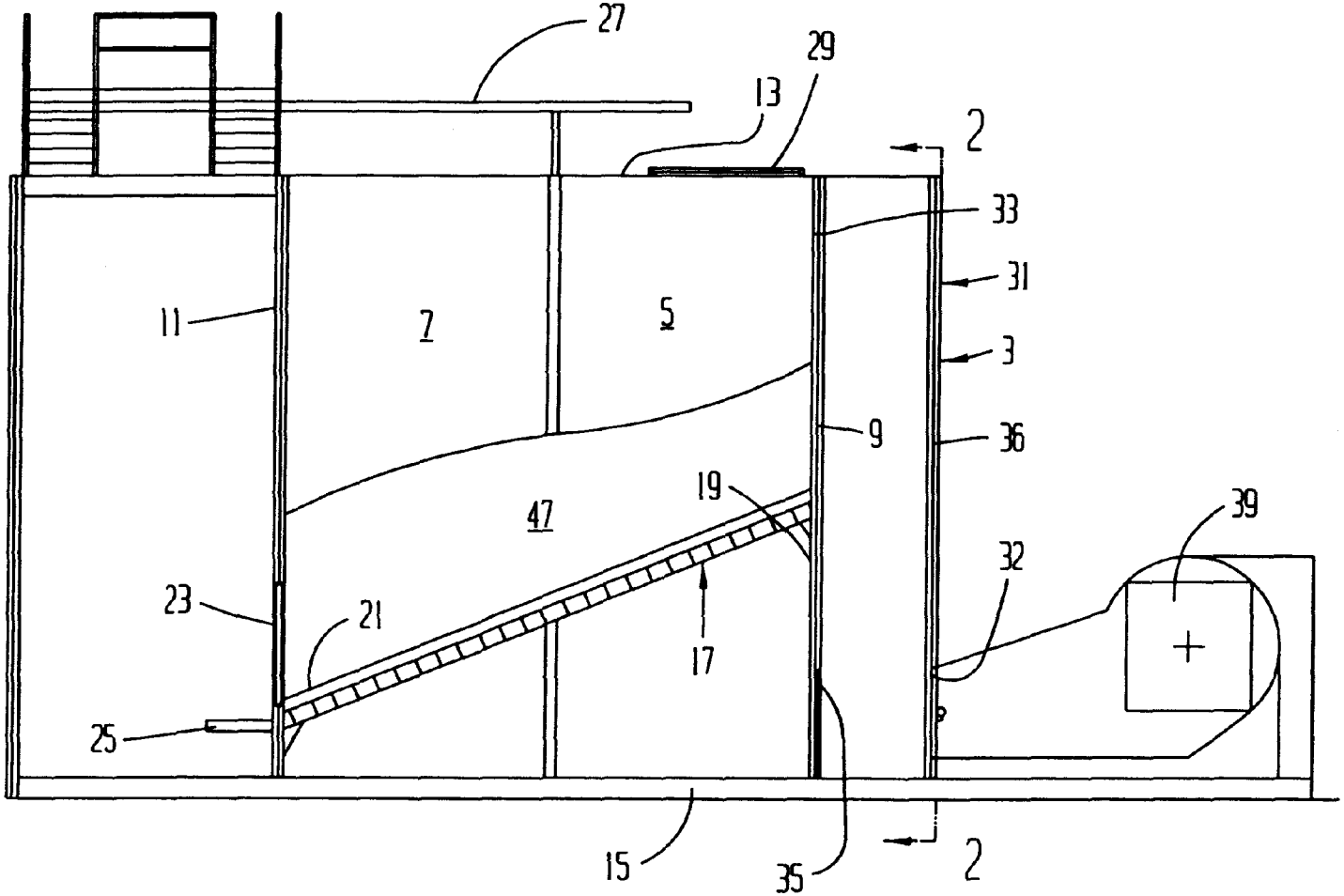
FIG. 1 is a schematic view of the interior of a pressurized enclosure that includes the present invention.
Figure 3:
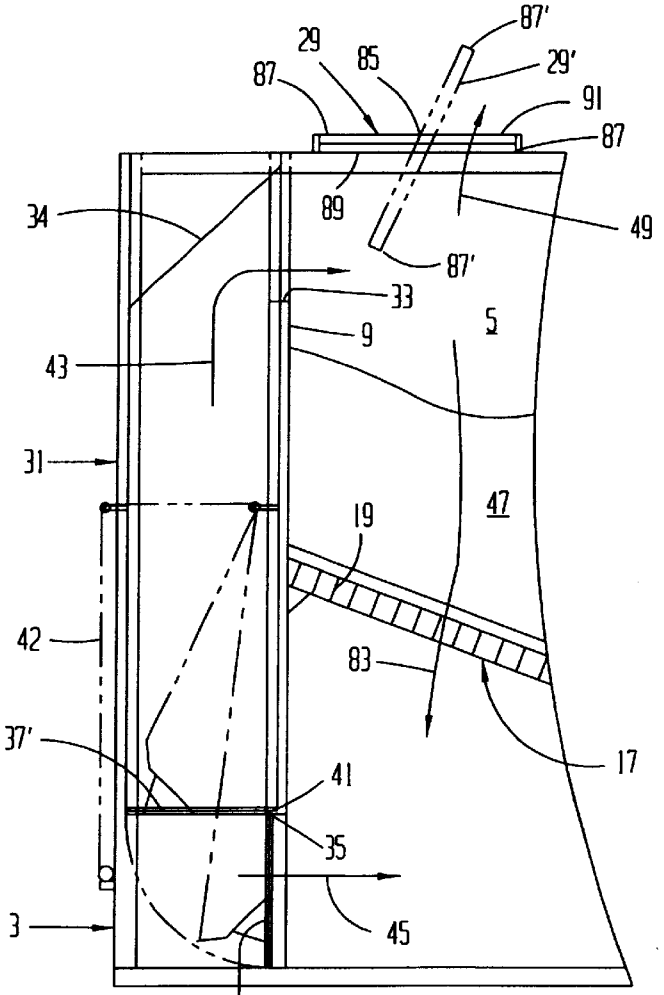
FIG. 3 is a schematic cross-sectional view taken along line 3—3 of FIG. 2.
Figure 2:
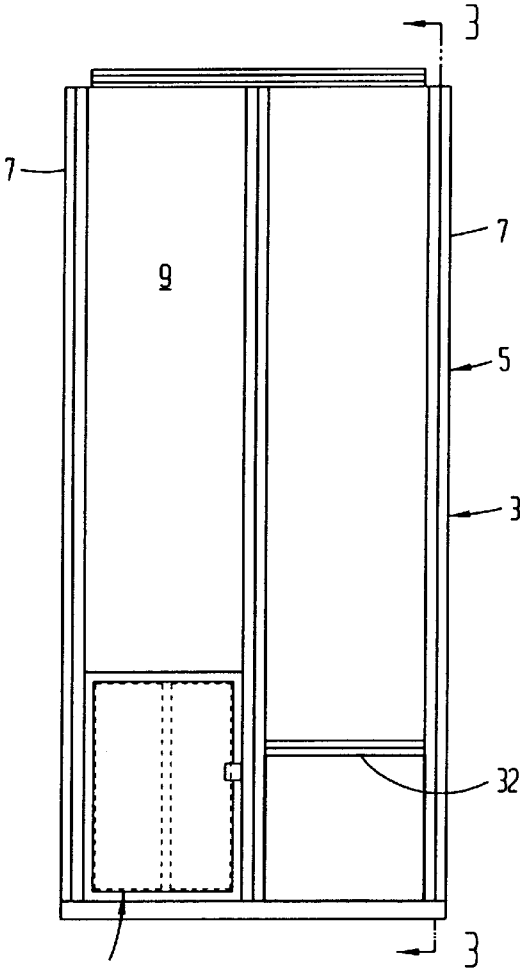
FIG. 2 is a view on an enlarged scale taken along line 2—2 of FIG. 1.
Figure 6:
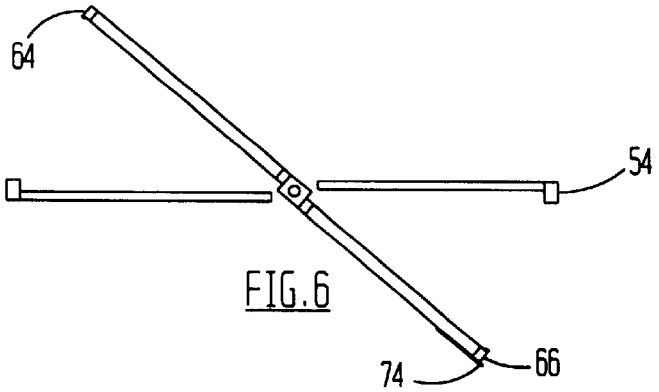
FIG. 6 is a view similar to FIG. 5, but showing the access door in the open position.
Figure 5:
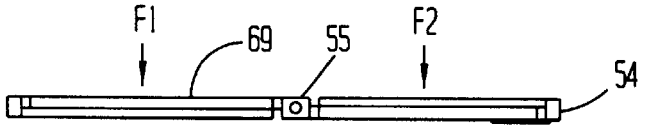
FIG. 5 is a top view of FIG. 4.
Figure 4:
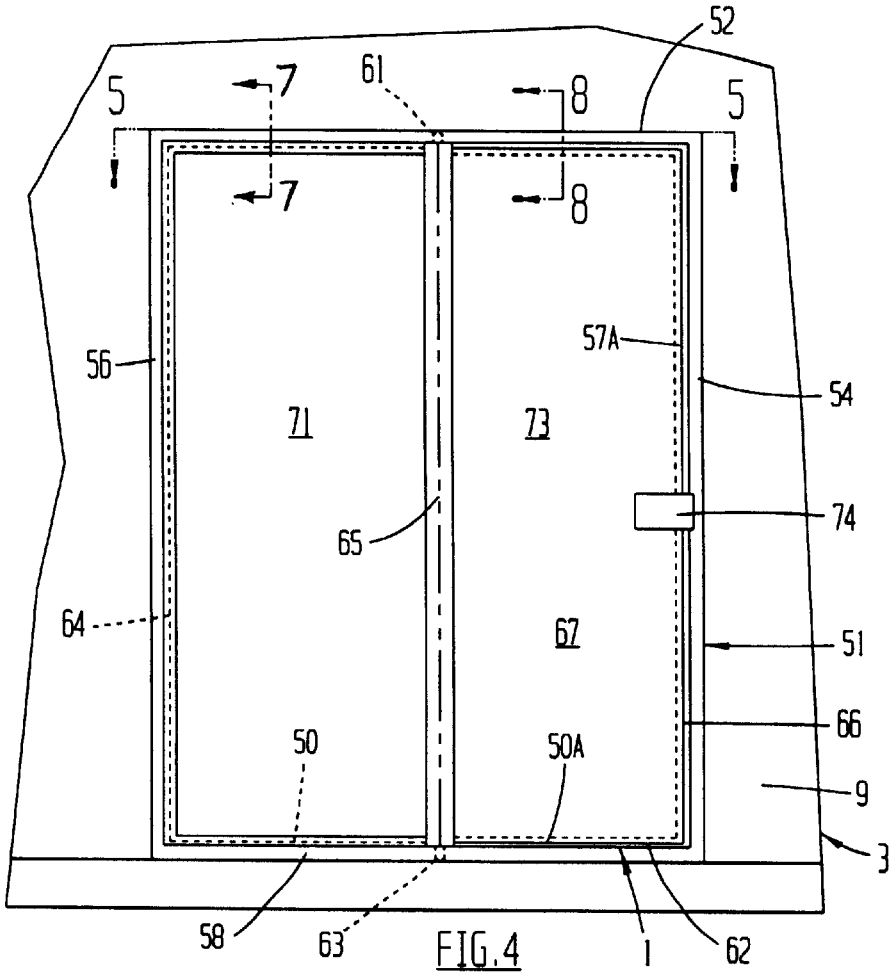
FIG. 4 is an enlarged front view of the access door of the invention.
Figure 8:
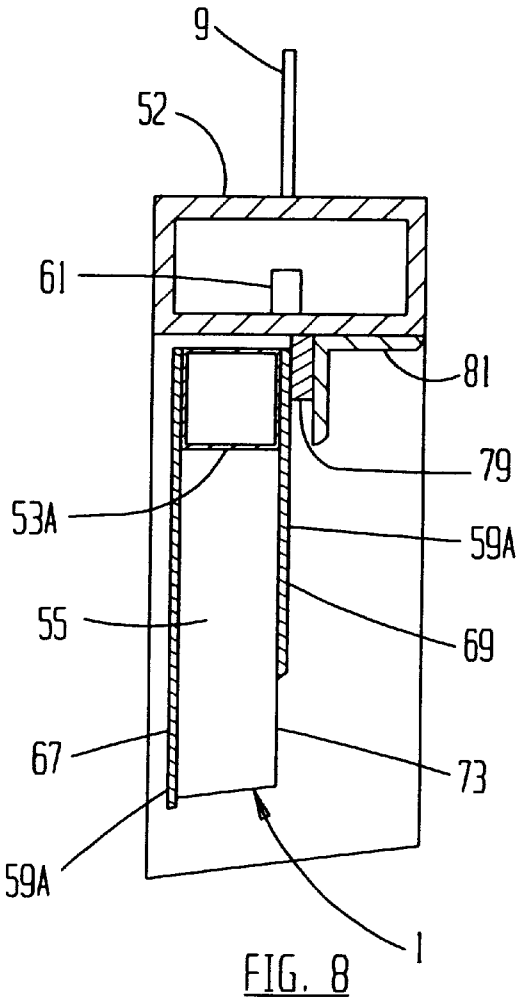
FIG. 8 is a cross-sectional view on an enlarged scale taken along line 8—8 of FIG. 4.
Figure 7:
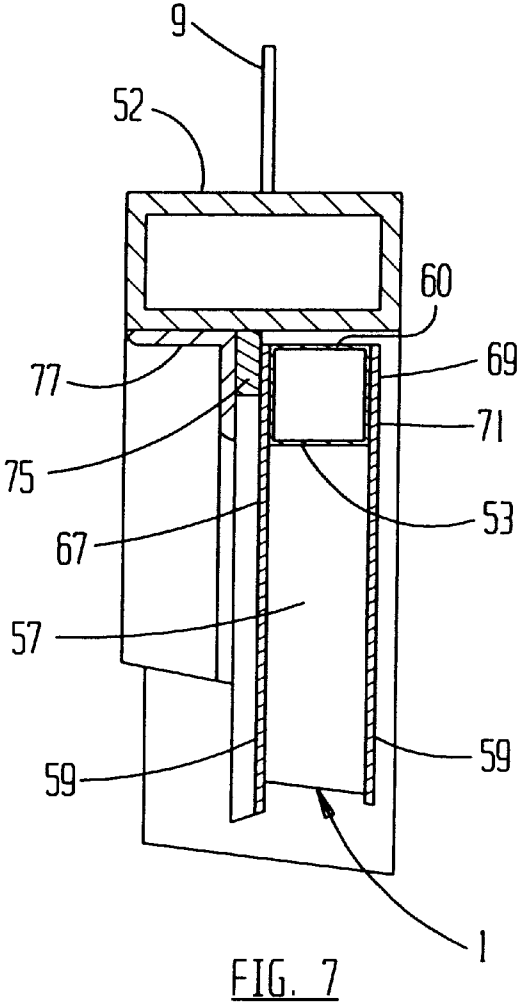
FIG. 7 is a cross-sectional view on an enlarged scale taken along line 7—7 of FIG. 4.

Referring to FIGS. 1–3, an access door 1 is illustrated that includes the present invention. The access door 1 is particularly useful for providing access to the interior of an ear corn dryer 3. However, it will be understood that the invention is not limited to agricultural applications. Further, the particular ear corn dryer 3 shown is merely representative of a wide variety of sizes and configurations of equipment used for drying ear corn for the seed industry.

As illustrated, the ear corn dryer 3 is comprised of a large enclosure 5 having side walls 7, a front wall 9, a back wall 11, a roof 13, and a floor 15. Inside the enclosure 5 is a perforated floor 17 that extends between the walls 7, 9, and 11. The perforated floor 17 has an upper end 19 at the enclosure front wall 9 that is higher than a lower end 21 at the enclosure back wall 11. There is a sliding door 23 in the back wall at the lower end 21 of the perforated floor. A conveyor 25 is on the outside of the enclosure back wall under the sliding door 23. There is another conveyor 27 on the enclosure roof 13. A fill door 29 in the roof is above the perforated floor upper end 19.

The ear corn dryer 3 further comprises a plenum 31 on the outside of the enclosure front wall 9. The plenum 31 has an opening 32 at the bottom of an outside wall 36. A large electrically operated blower 39 is mounted to the plenum outside wall 36 over the opening 32. There is a bottom opening 35 in the enclosure front wall 9 opposite the plenum opening 32. There is a screened top opening 33 at the top of the enclosure front wall between the enclosure 5 and the plenum 31. There may be an angled deflector 34 in the plenum opposite the top opening 33.

The enclosure bottom opening 35 is selectively openable and closeable by a diverter door 37. As best shown in FIG. 3, the diverter door 37 pivots about a hinge 41 in the enclosure front wall 9 between up and down positions. In the ear corn dryer 3 shown, pivoting of the diverter door is achieved by a manually operated chain and pulley arrangement 42. When the diverter door is in the up position 37' of FIG. 3, air can pass between the plenum 31 and the enclosure 5 through the enclosure bottom opening 35, as is shown by arrow 45. The door 37' prevents air flow up the plenum to the enclosure through the enclosure top opening 33.

The ear corn dryer 3 is used by dropping a load of ear corn 47 onto the perforated floor 17 through the fill door 29 by means of the conveyor 27. For drying the corn 47, the diverter door 37 is raised to the up position 37'. The blower 39 blows atmospheric air through the plenum opening 32 and the enclosure bottom opening 35 into the enclosure 5 under the corn 47. The air flows through the perforated floor 17 and the corn and out the opened fill door 29', as is shown by arrow 49, thereby drying the corn. During that time, the access door 1 is closed.

In accordance with the present invention, the access door 1 provides easy and safe entry into and exit from the enclosure 5 when the blower 39 is operating. Looking also at FIGS. 4–8, the access door fits in a casing 51 in the enclosure front wall 9. Preferably, the casing 51 is made from rectangular steel tubes: a top tube 52, side tubes 54 and 56, and a bottom tube 58.

In the particular construction illustrated, the access door 1 is composed of two horizontally offset panels 71 and 73 separated by a vertical central structural member 55 that is common to both panels. The first panel 71 has a horizontal top member 53, a similar bottom member 50, and a vertical end member 57. The second panel 73 has a horizontal top member 53A, a bottom member 50A, and a vertical end member 57A. Rectangular steel tubes are satisfactory for the access door top, bottom, central, and end members. A pair of metal sheets 59 are welded to the frame structural members 50, 53, 55, and 57 to complete the first panel. A pair of similar metal sheets 59A are welded to the structural members 50A, 53A, 55, and 57A to complete the second panel. The completed access door has a top edge 60, a bottom edge 62, and vertical side edges 64 and 66.

Protruding from the top of the access door's central structural member 55 is a pin 61. A similar pin 63 concentric with the pin 61 protrudes from the bottom of the access door central member. The pins 61 and 63 are received in the casing top and bottom tubes 52 and 58, respectively. Accordingly, the access door 1 can swing about a vertical axis of rotation 65 defined by the pins. The axis of rotation 65 divides the access door into the first panel 71 and the second panel 73. The access door swings between a closed position as shown in FIGS. 4, 5, 7, and 8, and an open position shown in FIG. 6. The access door thus has an outside face 67 and an inside face 69. A latch represented at reference numeral 74 holds the access door to the casing 51 when the access door is in the closed position.

When the access door 1 is closed, the margins of the outside face 67 around the edges 60, 62, and 64 of the first panel 71 abut a seal 75. The seal 75 is bonded to angles 77. The angles 77 are fastened to the casing tubes 52, 56, and 58 on the side of the casing that corresponds to the access door first panel 71. The strips 77 and seal 75 are located on the tubes 52, 56, 58 toward the outside face 67 of the access door.

When the access door 1 is closed, the margins of the access door inside face 69 around the edges 60, 62, and 66 of the second panel 73 abut a seal 79. The seal 79 is bonded to angles 81. The angles 81 are fastened to the casing tubes 52, 54, and 58 on the side of the casing that corresponds to the access door second panel 73. The angles 81 and seal 79 are located on the casing tubes 52, 54, and 58 toward the inside face 69 of the access door.

When the access door 1 is closed and the ear corn dryer 3 is operating to dry the corn 47 as described above, the air in the enclosure 5 is at a higher pressure than the atmospheric air on the outside of the enclosure. As a result, a force is exerted on the access door inside face 69. Specifically, there is a force F1 exerted on the access door first panel 71, and a force F2 exerted on the second panel 73. The force F1 urges the access door to swing toward the closed position such that the first panel 71 is in sealing contact with the seal 75 and the second panel 73 is in sealing contact with the seal 79. The force F2 urges the access door to swing toward the open position of FIG. 5 such that the panels 71 and 73 are urged away from the seals 75 and 79, respectively.

If the pins 61 and 63 are midway between the access door vertical edges 64 and 66, the forces F1 and F2 from the pressurized air in the enclosure 5 are equal. In that case, the forces F1 and F2 create equal and opposite torques on the closed access door 1 about the axis of rotation 65. Only a very slight external force needs to be exerted on the access door to open it. That is, a person can either lightly push the access door first panel 71 or he can pull on the second panel 73. In either case, the access door opens very easily and presents no danger to the person. He can open the access door, walk into the enclosure 5, and close the access door without fear of it slamming shut on him. Because of the equal forces on the two panels when the access door is closed, it may have a tendency to flutter. To prevent fluttering, as well as to prevent unintentional opening of the access door, the latch 74 is used.

In the preferred embodiment, a net torque is created on the access door 1 by the pressurized air. The net torque keeps the access door closed. It is preferred that the first panel 71 be larger in area than the second panel 73. Accordingly, the pins 61 and 63 are located closer to the access door edge 66 than to the edge 64. In that situation, a person must intentionally exert an initial measurable force to open the access door. The amount of the initial force is not critical. For example, the width of the first panel 71 may be approximately 15 percent and 20 percent larger than the width of the second panel 73. A suitable access door has a width of four feet and a height of eight feet. The axis,of rotation 65 is offset by two inches from the midpoint of the access door between the two vertical edges. At an air pressure of three inches of water inside the enclosure 5, there is a force difference of approximately 42 pounds on the first panel that urges the door closed. That small but measurable force is sufficient to keep the door tight against the seals 75 and 79, but a person can easily open the door against that force. As soon as the access door is opened a small amount under the initial force exerted by the person, the net torque from the pressurized air on the access door decreases toward zero. The person can then easily continue opening the door with a reduced secondary force to a position that allows him to walk safely through the casing 51. The small net torque on the access door greatly reduces the probability of injury if the access door should accidentally close.

The access door 1 contributes a further benefit to the ear corn dryer 3 during a reverse drying operation. During reverse drying, the fill door 29 is closed, and the access door is open. Returning to FIG. 3, the diverter door 37 is lowered to the down position by the chain and pulley arrangement 42. When the diverter door is in the down position, it blocks passage of air from the blower 39 (FIG. 1) and the plenum opening 32 into the enclosure 5 through the enclosure opening 35. Instead, drying air flows from the plenum opening 32 into the enclosure through the enclosure top opening 33, as shown by arrow 43. Drying air flows downwardly through the corn 47 and the perforated floor 17, arrow 83, and out the open access door. If the prop holding the access door open should accidentally be removed, the access door does not rapidly slam shut with the possibility of injuring a nearby person. That is because only the small net torque described above is created on the access door from the pressurized air when the access door approaches the closed position.

Further in accordance with the present invention, the fill door 29 can be constructed using the same principle as the access door 1. That is, the fill door can have a horizontal axis of rotation 85 that is offset from the midpoint between the fill door edges 87 to make a first panel 89 and a smaller second panel 91. When the fill door is closed during reverse drying operation, the force from the pressurized air in the enclosure 5 holds the fill door closed against seals, not shown. On the other hand, the fill door can be easily opened if needed during reverse drying with a minimum of effort or danger.

In summary, the results and advantages of ear corn dryers can now be more fully realized. The access door 1 remains closed by a small net torque during operation of the ear corn dryer 3, but the access door requires only a small initial force to open it safely. This desirable result comes from using the combined functions of the pins 61 and 63 and the seals 75 and 79. The pins are offset from the midpoint between the access door edges 64 and 66 such that the door first panel 71 has a larger area than the second panel 73. The pressure of the air inside the enclosure 5 produces a greater force on the first panel than on the second panel, which keeps the access door closed against the seals. On the other hand, the net torque on the access door is small such that the access door can be opened easily. Further, the access door does not have a tendency to slam shut quickly if it is not constantly held open. The principle of the access door is also applicable to the ear corn dryer fill door 29.

It will also be recognized that in addition to the superior performance of the access door, its construction is such as to be of modest cost in relation to the benefits it provides. Also, because it is made of a simple design and with rugged components, the need for maintenance is minimal.

Thus, it is apparent that there has been provided, in accordance with the invention, a door for ear corn dryers that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An ear corn dryer comprising:

a. an enclosure defined by side walls, a back wall, a front wall, a floor, and a roof;

b. means for holding corn in the enclosure;

c. means for producing air pressure within and air flow through the enclosure to dry the corn; and d. a door in a selected enclosure wall comprising:

i. a casing in the selected wall;

ii. an access door having opposed edges and a midpoint therebetween; and iii. means for swinging the access door between opened and closed positions in the casing about an axis of rotation located between the access door opposed edges, the axis of rotation dividing the access door into first and second panels such that the first panel is inside the enclosure and the second panel is outside the enclosure when the access door is in the open position, so that air pressure inside the enclosure produces forces on the access door first and second panels and thereby creates opposite torques about the axis of rotation.

2. The ear corn dryer of claim 1 wherein the means for swinging the access door comprises a pair of concentric pins protruding from the access door and received in the casing to enable the access door to swing in the casing between opened and closed positions, the pins defining the axis of rotation.

3. The ear corn dryer of claim 2 wherein the axis of rotation is offset from the axis door midpoint such that the first panel has a greater area than the second panel, so that the air pressure in the enclosure produces a greater force on the first panel than on the second panel when the access door is in the closed position.

4. The ear corn dryer of claim 3 wherein the access door first panel has an area that is between approximately 15 percent and 20 percent greater than the area of the second panel.

5. The ear corn dryer of claim 1 wherein the casing comprises:

a. first seal means for sealing between the casing and the access door first panel when the access door is in the closed position; and b. second seal means for sealing between the casing and the access door second panel when the access door is in the closed position.

6. The ear corn dryer of claim 1 wherein the door is in the enclosure front wall.

7. The ear corn dryer of claim 1 wherein the door is in the enclosure roof.

8. The ear corn dryer of claim 2 wherein the axis of rotation coincides with the access door midpoint, so that the forces from the air pressure in the enclosure on the access door first and second panels are equal.

9. The ear corn dryer of claim 8 further comprising means for latching the access door to the casing when the access door is in the closed position to thereby prevent the access door from fluttering when it is in the closed position.

10. A door in a wall of an enclosure having pressurized air therein comprising:

a. a casing in the enclosure wall; and b. an access door having opposed edges and bidirectionally swingable in the casing about an axis of rotation located between the opposed edges between open and closed positions, the axis of rotation dividing the access door into a first panel that is inside the enclosure when the access door is in the open position and a second panel that is outside the enclosure when the door is in the open position, so that the pressurized air produces forces on the access door first and second panels that create opposite torques on the access door about the axis of rotation.

11. The door of claim 10 wherein the access door axis of rotation is midway between the opposed edges, so that the forces produced by the pressurized air on the first and second panels are equal.

12. The door of claim 11 further comprising means for latching the access door to the casing when the access door is in the closed position to thereby prevent the access door from fluttering under the equal forces on the first and second panels.

13. The door of claim 10 wherein:

a. the access door has a first face that is toward the outside of the enclosure when the access door is in the closed position, and a second face that is toward the inside of the enclosure when the access door is in the closed position; and b. the door further comprises:

i. first means for sealing between the first face of the access door and the casing when the access door is in the closed position; and ii. second means for sealing between the second face of the access door and the casing when the access door is in the closed position.

14. The door of claim 10 wherein the access door first panel has a larger area than the second panel, so that the pressurized air in the enclosure exerts a larger force on the first panel than on the second panel such that a net torque is created on the access door about the axis of rotation that keeps the access door in the closed position.

15. The door of claim 14 wherein the access door first panel has an area that is approximately 15 percent to 20 percent larger than the area of the second panel.

16. Apparatus for providing access by a person to the interior of an enclosure having a wall and containing air under pressure comprising a door that is swingable in a first direction to an open position whereat a person can walk through the wall and in a second direction to a closed position whereat the person is prevented from walking through the wall, the door swinging about an axis of rotation located between first and second opposed edges of the door, the axis of rotation dividing the door into a first panel having a first area and a second panel having a second area, the first panel being inside the enclosure and the second panel being outside the enclosure when the door is in the open position, the door having a first face that is toward the outside of the enclosure and the second face that is toward the inside of the enclosure when the door is in the closed position, the door having forces from the air under pressure acting on the first and second panels that create opposite torques on the door about the axis of rotation when the door is in the closed position.

17. The apparatus of claim 16 wherein the axis of rotation is midway between the door opposed edges, so that the first and second panel areas are substantially equal and the forces from the air under pressure acting on the first and second panels are substantially equal.

18. The apparatus of claim 17 further comprising means for latching a selected one of the door panels to the enclosure wall to thereby prevent the door from fluttering under the forces acting on the first and second panels.

19. The apparatus of claim 16 wherein the door first panel area is greater than the second panel area, so that the air under pressure creates a net torque on the door about the axis of rotation that keeps the door in the closed position.

20. The apparatus of claim 16 further comprising means for sealing the first face of the first panel and the second face of the second panel to the wall when the door is in the closed position, the means for sealing being out of sealing contact with the door when the door is in the open position.

21. A method of selectively providing and preventing entrance by a person through a wall into the interior of an enclosure containing pressurized air comprising the steps of:

a. providing an opening in the enclosure wall;

b. providing a door having opposed first and second edges and an axis of rotation therebetween that divides the door into first and second panels;

c. swinging the door in the wall opening in a first direction to a closed position whereat a person cannot enter the enclosure;

d. producing forces from the pressurized air on the door first and second panels such that opposing torques about the axis of rotation are created on the door; and e. swinging the door about the axis of rotation in a second direction to an open position whereat a person can enter the enclosure.

22. The method of claim 21 wherein:

a. the step of providing an opening comprises the step of providing first and second seals in the opening;

b. the step of providing a door comprises the step of providing the door with a first face that is toward the outside of the enclosure when the door is in the closed position and a second face that is toward the inside of the enclosure when the door is in the closed position;

c. the step of swinging the door to the closed position comprises the steps of sealing the door first face against the first seal, and sealing the door second face against the second seal when the door is in the closed position; and d. the step of swinging the door to the open position comprises the steps of removing the door first face from against the first seal, and removing the door second face from against the second seal.

23. The method of claim 21 wherein:

a. the step of providing a door comprises the step of locating the axis of rotation midway between the door first and second opposed edges; and b. the step of producing forces comprises the step of producing equal forces from the pressurized air on the door first and second panels.

24. The method of claim 21 comprising the further step of latching the door in the closed position.

25. The method of claim 21 wherein:

a. the step of providing a door comprises the step of providing a door having the first panel with a greater area than the second panel; and b. the step of producing forces comprises the step of producing a greater force from the pressurized air on the first panel than on the second panel and thereby creating a net torque about the axis of rotation in a direction that keeps the door in the closed position.

26. The method of claim 25 wherein the step of swinging the door to an open position comprises the steps of:

a. exerting an initial force by a person on a selected one of the first and second panels sufficient to overcome the net torque on the door and thereby initially swinging the door in the second direction toward an open position; and b. exerting a secondary force less than the initial force on the door and continuing swinging the door toward the open position.

* * * * *